US009321270B2

(12) United States Patent
Kim et al.

(10) Patent No.: US 9,321,270 B2
(45) Date of Patent: Apr. 26, 2016

(54) APPARATUS FOR PREVENTING CLOGGING OF PRINTER NOZZLE AND PRINTER INK CARTRIDGE

(71) Applicant: Soongsil University Research Consortium Techno-Park, Seoul (KR)

(72) Inventors: Jin Oh Kim, Seoul (KR); Dae Jong Kim, Siheung (KR)

(73) Assignee: SOONGSIL UNIVERSITY RESEARCH CONSORTIUM TECHNO-PARK, Seoul (KR)

( * ) Notice: Subject to any disclaimer, the term of this patent is extended or adjusted under 35 U.S.C. 154(b) by 0 days.

(21) Appl. No.: 14/699,016

(22) Filed: Apr. 29, 2015

(65) Prior Publication Data

US 2015/0314604 A1 Nov. 5, 2015

(30) Foreign Application Priority Data

Apr. 30, 2014 (KR) ..... 10-2014-0052352

(51) Int. Cl.
*B41J 2/165* (2006.01)

(52) U.S. Cl.
CPC .... *B41J 2/16517* (2013.01); *B41J 2002/16567* (2013.01)

(58) Field of Classification Search
CPC ..... B41J 2002/16567
USPC ..... 347/27
See application file for complete search history.

(56) References Cited

U.S. PATENT DOCUMENTS 5,172,141 A * 12/1992 Moriyama ..... B41J 2/1429 347/40
2001/0007462 A1* 7/2001 Jeong ..... B41J 2/14209 347/72

FOREIGN PATENT DOCUMENTS

KR 10-0637427 B1 10/2006
KR 10-1124211 B1 3/2012

* cited by examiner

*Primary Examiner* — Julian Huffman
(74) *Attorney, Agent, or Firm* — Pearne & Gordon LLP

(57) ABSTRACT

A printer nozzle apparatus, including a nozzle that sprays ink, at least one vibration unit that is arranged on one surface of the nozzle and of a ring shape, and a controller that controls a vibration frequency of the vibration unit.

7 Claims, 6 Drawing Sheets

APPARATUS FOR PREVENTING CLOGGING OF PRINTER NOZZLE AND PRINTER INK CARTRIDGE

CROSS-REFERENCE TO RELATED APPLICATION

This application claims the benefit of Korean Patent Application No. 10-2014-0052352 filed on Apr. 30, 2014, the disclosures of which are incorporated herein by reference.

TECHNICAL FIELD

The embodiments described herein pertain generally to a printer nozzle apparatus for preventing clogging of printer nozzle and a printer ink cartridge.

BACKGROUND

Inkjet printers can be divided into small- and medium-sized printers and large-sized printers depending on size of the inkjet printers. The small- and medium-sized printers are being mostly used for homes, offices and others, and the large-sized printers are being mostly used for industrial purposes.

In addition, technologies relating to 3-dimensional (3D) printers, as well as the inkjet-based 2D printers, have been rapidly developed over years. Recently, 3D printers for desktops have lead to increased popularization of the 3D printers, and the 3D printers are becoming widely available through Internet shopping.

On Jan. 29, 2014, the Overseas Economic Research Institute of Korea forecasted that "As 3D printers will advance the era of customized small quantity batch production, differentiated products and companies beyond the manufacturing structure for mass production will be created, and one-man companies will increase," and in the meantime, stated that "While interested ones forecasted at the initial stage that 3D printers will replace all manufacturing processes, we expect that specialized areas such as artificial internal organs, ultra-precision processing, and personal DIY will be newly founded due to restrictions in materials, manufacturing costs, time and others," and "This can be a chance to reorganize global manufacturing business competitiveness, like the phenomenon that the manufacturing business that has moved to Asia will be returned back to the R&D advanced countries such as the U.S.A."

Printing techniques of general 3D printers are divided into a fused deposition modeling (FDM) technique, a digital light processing (DLP) technique, a stereolithography apparatus (SLA) technique, and a selective laser sintering (SLS) technique. In addition, food materials as well as various types of materials such as ceramic, plastic, metal and resin are also being used for the 3D printers.

Meanwhile, in case of the conventional inkjet technique, various research to resolve the problem of nozzle clogging caused by ink curing in an ink nozzle has been conducted. Since the nozzle clogging phenomenon may also occur in the 3D printing techniques that spray certain liquid through a nozzle as in the inkjet technique, research and technology development to resolve the nozzle clogging problem is also necessary.

For example, 3D printing by the FDM technique accomplishes modeling by melting a thermal curable material in a filament form like a fine thread through a heated nozzle to output the material in a thin film form or depositing liquid sprayed through the nozzle layer by layer. The filament deposited according to the FDM technique is cured at a room temperature so that a final output is produced, but there is a disadvantage in that the melted material is cured at one end of the nozzle.

Meanwhile, Korean Patent Publication No. 10-1124211 (Title of Invention: Inkjet Printer Provided with Nozzle Clogging Resolving Apparatus and Nozzle Clogging Resolving Method Using the Same) resolves nozzle clogging by determining a non-printed area and spraying, by force, ink corresponding to a color of the area that has not been printed.

SUMMARY

In view of the foregoing, some of example embodiments provide a printer nozzle apparatus capable of preventing clogging of a printer nozzle and a printer ink cartridge.

However, the problems sought to be solved by the present disclosure are not limited to the above description and other problems can be clearly understood by those skilled in the art from the following description.

In one example embodiment, there may be provided a printer nozzle apparatus, comprising a nozzle that sprays ink, at least one vibration unit that may be arranged on one surface of the nozzle and of a ring shape, and a controller that controls a vibration frequency of the vibration unit.

If the vibration unit is plural in number, the controller may control at least one of a plurality of the vibration units to have a different vibration frequency from other vibration units.

The vibration units may be arranged along an outer surface of the nozzle to be in the form surrounding a part of the outer surface of the nozzle, and the respective vibration unit may be arranged in a longitudinal direction of the nozzle at predetermined intervals.

The vibration units may be arranged along an inner peripheral surface of the nozzle to be in the form surrounding a part of the inner peripheral surface of the nozzle, and the respective vibration unit may be arranged in a longitudinal direction of the nozzle at predetermined intervals.

The vibration unit may have at least one segment unit, and the segment units may be combined to one another to enable the vibration unit to be fixed and arranged on one surface of the nozzle or separated from one another to enable the vibration unit to be separated from one surface of the nozzle.

The nozzle may be mounted at a certain position within a 3D printer, and the vibration unit may be a piezoelectric transducer that receives an electric signal delivered from the controller to generate ultrasonic vibrations.

In another example embodiment, there is provided the printer ink cartridge, comprising the nozzle that sprays ink, and at least one vibration unit that is arranged on one surface of the nozzle and of the ring shape. Herein, the vibration unit is electrically connected to the printer mounted with the printer ink cartridge, and a vibration frequency of the vibration unit is controlled by the printer.

If the vibration unit is plural in number, a vibration frequency of at least one of the plurality of the vibration units may be controlled to be different from other vibration units.

The vibration unit may have at least one segment unit, and the segment units may be combined to one another to enable the vibration unit to be fixed and arranged on one surface of the nozzle or separated from one another to enable the vibration unit to be separated from one surface of the nozzle.

In accordance with the example embodiments, when a certain material (ink or others) for printing is sprayed, coagulation of a residual material can be prevented, and residuals and others remaining around a nozzle after the spray of the material can be effectively removed.

In addition, since a multiple number of vibration units (e.g., piezoelectric transducers) are arranged with a spacing from one another across the entire outer or inner surface of the nozzle, and not at one end of the nozzle, condensation of the material over the entire area of the nozzle can be prevented, and an optimum condition for spraying the material can be provided.

Since the vibration units in accordance with an example embodiment vibrate at different vibration frequencies, it is possible to more effectively prevent coagulation of the material than a single frequency vibration method.

In addition, since the vibration unit in accordance with another example embodiment includes at least one segment unit, a user can easily attach or detach the vibration unit when manufacturing, using or replacing the vibration unit.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
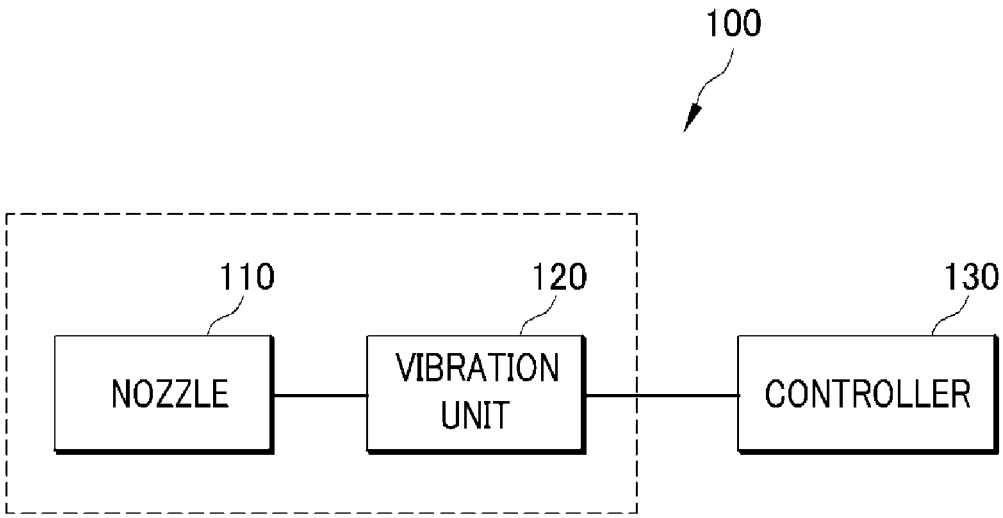
FIG. 1 is a configuration view of a printer nozzle apparatus in accordance with an example embodiment.

Hereinafter, example embodiments will be described in detail with reference to the accompanying drawings so that inventive concept may be readily implemented by those skilled in the art. However, it is to be noted that the present disclosure is not limited to the example embodiments, but can be realized in various other ways. In the drawings, certain parts not directly relevant to the description are omitted to enhance the clarity of the drawings, and like reference numerals denote like parts throughout the whole document.

Throughout the whole document, the terms "connected to" or "coupled to" are used to designate a connection or coupling of one element to another element and include both a case where an element is "directly connected or coupled to" another element and a case where an element is "electronically connected or coupled to" another element via still another element.

Throughout the whole document, the term "on" that is used to designate a position of one element with respect to another element includes both a case in which the one element is adjacent to the another element and a case in which any other element may be positioned between these two elements.

Specific example embodiments are described in detail with reference to the accompanying drawings. However, the technical idea of the present disclosure is not limited to the example embodiments described hereinafter, and another example embodiment may be easily created by specifying, changing, deleting, adding one or more components within the same scope of a technical idea, from which the technical idea of the present disclosure can be understood, but falls under the scope of the present disclosure.

Throughout the whole document, the term "comprises or includes" and/or "comprising or including" means that one or more other components, steps, operations, and/or the existence or addition of elements are not excluded in addition to the described components, steps, operations and/or elements. Throughout the whole document, the term "step of" does not mean "step for."

FIG. 1 is a configuration view of a printer nozzle apparatus in accordance with an example embodiment.

With reference to FIG. 1, the printer nozzle apparatus 100 in accordance with an example embodiment may include a nozzle 110, a vibration unit 120 and a controller 130.

The nozzle 110 may spray ink. In one example, a material for printing may be sprayed through the nozzle 110. For example, the material may be, but not limited to, ink, a thermoplastic material or others, and may include any material that can be used for 3D printers.

At least one vibration unit 120 may be coupled to the nozzle 110. In one example, the at least one vibration unit 120 may be arranged on one surface of the nozzle 110, and of a ring shape. Size, shape and, the number of the vibration units 120 may vary and are not specifically limited. For example, one or more vibration units 120 may be used.

The controller 130 may be operably coupled to the at least one vibration unit 120, and may control a vibration frequency of at least one vibration unit 120.

In addition, if the vibration unit 120 is plural in number, the controller 130 may control at least one of a multiple number of the vibration units 120 such that at least the one of the multiple number of the vibration units 120 may have a different vibration frequency from other vibration units. Through the control of the vibration frequencies of the vibration units 120, clogging of the nozzle 110 may be effectively prevented.

For example, the controller 130 may control a first vibration unit to vibrate at 50 Hz, and a second vibration unit to vibrate at 110 Hz. However, the vibration frequencies enumerated above are merely examples, and the vibration frequencies of the vibration units are not limited thereto.

In addition, the controller 130 may control the vibration frequency of the vibration unit 120 such that vibration is provided to the nozzle 110 at a pre-set, designated time or at all times. Accordingly, it is possible to prevent coagulation of the printing material even when a user does not use the printer, and thereby, preventing clogging of the nozzle 110 in advance. Further, since the coagulation of the printing material may be prevented, there is an advantage in consistently maintaining the quality of a printing output.

Figure 2A:
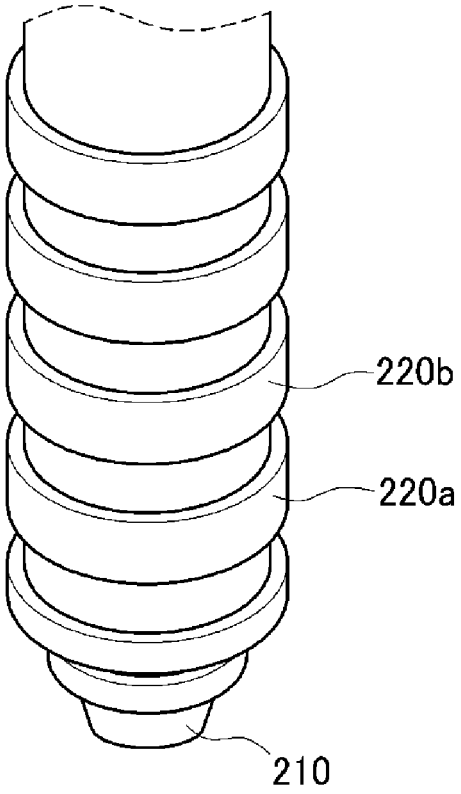
FIG. 2A shows an example for a nozzle and a vibration unit of FIG. 1.
Figure 2B:
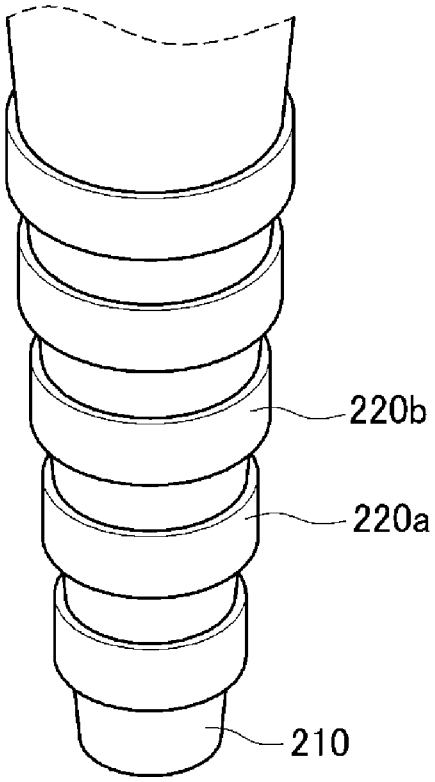
FIG. 2B shows another example for the nozzle and the vibration unit of FIG. 1.

FIG. 2A shows an example for the nozzle and the vibration unit of FIG. 1, and FIG. 2B shows another example for the nozzle and the vibration unit of FIG. 1.

With reference to each of FIG. 2A and FIG. 2B, in the printer nozzle apparatus in accordance with an example embodiment, vibration units 220*a*, 220*b* may be arranged along an outer surface of the nozzle 210 to be in the form surrounding a part of the outer surface of the nozzle 210, and may be arranged in a longitudinal direction of the nozzle 210 at predetermined intervals.

The vibration units 220*a*, 220*b* illustrated in FIG. 2A in accordance with an example embodiment may be combined or arranged onto the outer surface of the nozzle 210 to be in the form surrounding the part of the outer surface of the cylindrical nozzle 210. As shown, the vibration units 220*a*, 220*b* may be of a ring or donut shape, and diameters of the vibration units 220*a*, 220*b* at an upper portion of the nozzle may be the same as diameters of the vibration units at a lower portions thereof.

In addition, the vibration units 220*a*, 220*b* illustrated in FIG. 2B in accordance with another example embodiment may be combined or arranged onto the outer surface of the nozzle 210 to be in the form surrounding the part of the outer surface of the conical nozzle 210. In this case, the vibration units 220*a*, 220*b* may be of a ring or donut shape, and diameters of upper portions of the vibration units 220*a*, 220*b* may be different from diameters of lower portions thereof.

In the printer nozzle apparatus in accordance with another example embodiment, the vibration units (not illustrated) may be arranged along an inner peripheral surface of the nozzle to be in the form surrounding the part of the inner peripheral surface of the nozzle, and may be arranged in a longitudinal direction of the nozzle at predetermined intervals.

Meanwhile, the nozzle 210 may be mounted at a certain position within a general inkjet printer or a 3D printer. In this case, the certain potion is not specifically limited by a type and a shape of the inkjet printer or the 3D printer.

In addition, the vibration units 220*a*, 220*b* may be piezoelectric transducers that receive an electric signal delivered from the controller to generate ultrasonic vibrations. Here, the piezoelectric transducers are devices that mechanically convert 20 kHz or higher alternating energy into mechanical vibration having the same frequency by using an piezoelectric effect.

FIG. 3 specifically illustrates the vibration unit.

Figure 3A:
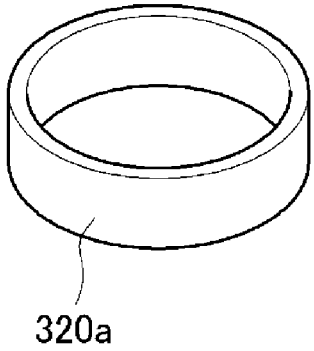
FIGS. 3A and 3B specifically illustrate still other examples of the vibration unit.
Figure 3B:
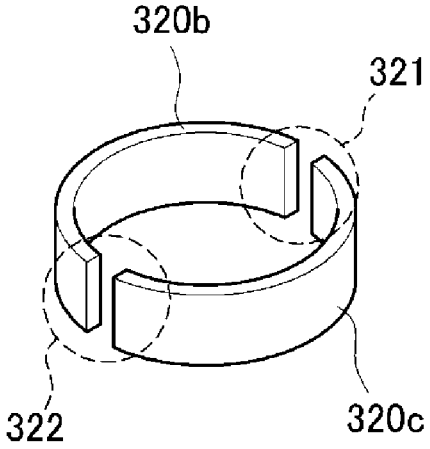

With reference to FIG. 3A, a vibration unit 320*a* in accordance with an example embodiment may be of a unitary ring shape. With reference to FIG. 3B, a vibration unit may be provided in the form of segment units 320*b*, 320*c* in accordance with another example embodiment may be distinct as shown at 321, 322. The segment units 320*b*, 320*c* may are combined to each other to be fixed and arranged on one surface of the nozzle or separated from each other such that the segment units 320*b*, 320*c* are separated from one surface of the nozzle.

For example, the segment type of the vibration units may be individually manufactured to be combined to the nozzle, and the vibration unit may be combined with the nozzle by various combining method, including but not limited to, additional mechanical coupling, magnetic couplings or others.

In addition, if the vibration unit having the consecutive ring shape cannot be mounted on the inner or outer peripheral surface of the nozzle, it is possible to facilitate the combination of the nozzle and the vibration unit by using the vibration unit including at least one segment unit.

Hereinafter, a printer ink cartridge in accordance with an example embodiment is described, and components identical/similar to the above-described components or overlapping descriptions are briefly described or omitted.

Figure 4:
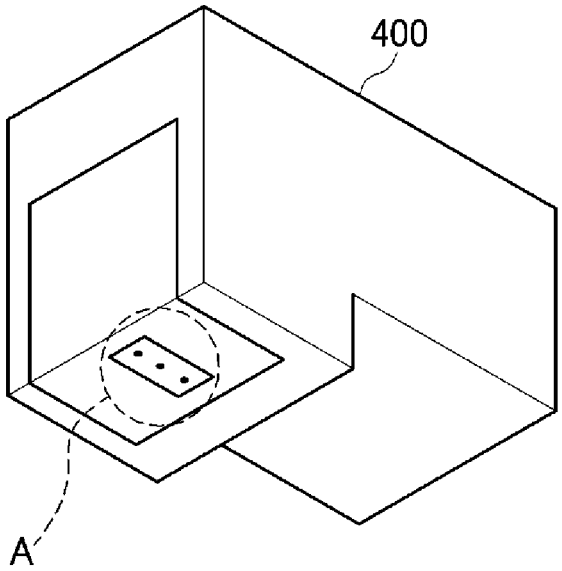
FIG. 4 is a schematic view of a printer ink cartridge in accordance with an example embodiment.
Figure 5:
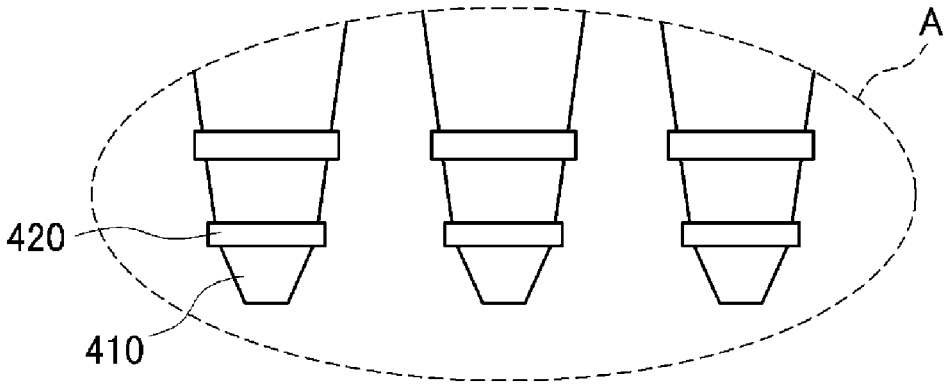
FIG. 5 is a side view of the nozzle A of FIG. 4.

FIG. 4 is a schematic view of the printer ink cartridge in accordance with an example embodiment, and FIG. 5 is a side view of the nozzle A of FIG. 4.

With reference to FIG. 4 and FIG. 5, a printer ink cartridge 400 in accordance with an example embodiment may include a nozzle 410 and a vibration unit 420.

The nozzle 410 sprays ink, and at least one vibration unit 420 is arranged on one surface of the nozzle and of the ring shape.

A vibration unit 420 is electrically connected to a printer mounted with the printer ink cartridge 400, and a vibration frequency of the vibration unit 420 may be controlled by the printer.

In addition, a vibration frequency of at least one of a multiple number of the vibration units 420 may be differently controlled by a controller.

In addition, the vibration unit 420 may have at least one segment unit. The segment units may be combined to each other such that the vibration unit 420 is fixed and arranged on one surface of the nozzle 410 or separated from each other such that the vibration unit 420 is separated from one surface of the nozzle 410.

According to the technology suggested by the example embodiments, it is possible to prevent coagulation of a residual material by vibration of the vibration units surrounding the periphery (e.g., an outer or inner peripheral surface) of the nozzle when a certain material (ink or the like) for inkjet printing or 3D printing is sprayed.

In addition, since a multiple number of vibration devices (e.g. piezoelectric transducers) are arranged on one surface of the nozzle while being spaced from one another, and vibration can be delivered through the controller for certain period of time, clogging of the nozzle can be prevented, regardless of whether the printer is being used or not.

In addition, the vibration devices in accordance with an example embodiment are controlled by the controller to vibrate the vibration units at different vibration frequencies, which makes it possible to more effectively prevent clogging of the entire nozzle.

In addition, since the vibration device in accordance with another example embodiment includes at least one segment unit, a user can easily attach or detach the vibration device when manufacturing, using or replacing the vibration device.

The above description of the example embodiments is provided for the purpose of illustration, and it would be understood by those skilled in the art that various changes and modifications may be made without changing technical conception and essential features of the example embodiments. Thus, it is clear that the above-described example embodiments are illustrative in all aspects and do not limit the present disclosure. For example, each component described to be of a single type can be implemented in a distributed manner. Likewise, components described to be distributed can be implemented in a combined manner.

The components and functions thereof can be combined with each other or can be divided. Reference to "a" unit does not limit the claim to only one of such unit, but could encompass an apparatus having more than one of such unit.

The scope of the present invention is defined by the following claims rather than by the detailed description of the embodiment. It shall be understood that all modifications and embodiments conceived from the meaning and scope of the claims and their equivalents are included in the scope of the present invention.

We claim:

1. A printer nozzle apparatus, comprising:

a nozzle that sprays ink;

a plurality of vibration units that are arranged on one surface of the nozzle and of a ring shape; and a controller that controls vibration frequencies of the plurality of vibration units, wherein the controller controls one of the plurality of vibration units to have a vibration frequency different from the vibration frequencies of other of the vibration units.

2. The printer nozzle apparatus of claim 1, wherein the plurality of vibration units are arranged along an outer surface of the nozzle to be in a form surrounding part of the outer surface of the nozzle, and the plurality of vibration units are arranged in a longitudinal direction of the nozzle at intervals.

3. The printer nozzle apparatus of claim 1, wherein the plurality of vibration units are arranged along an inner peripheral surface of the nozzle to be in a form surrounding part of the inner peripheral surface of the nozzle, and the plurality of vibration units are arranged in a longitudinal direction of the nozzle at intervals.

4. The printer nozzle apparatus of claim 1, wherein each of the vibration units has at least two segment units, and the at least two segment units are combined to one another to enable each of the vibration units to be fixed and arranged on one surface of the nozzle or separated from one another to enable each of the vibration units to be separated from one surface of the nozzle.

5. The printer nozzle apparatus of claim 1, wherein the nozzle is mounted at a certain position within a 3D printer, and each of the vibration units is a piezoelectric transducer that receives an electric signal delivered from the controller to generate ultrasonic vibrations.

6. A printer ink cartridge, comprising:

a nozzle that sprays ink; and a plurality of vibration units that are arranged on one surface of the nozzle and of a ring shape, wherein the plurality of vibration units are electrically connected to a printer mounted with the printer ink cartridge, and vibration frequencies of the plurality of vibration units are controlled by the printer, and a vibration frequency of the one of the plurality of vibration units is controlled to be different from the vibration frequencies of other of the vibration units.

7. The printer ink cartridge of claim 6, wherein each of the vibration units has at least two segment units, and the segment units are combined to one another to enable each of the vibration units to be fixed and arranged on one surface of the nozzle or separated from one another to enable each of the vibration units to be separated from one surface of the nozzle.

* * * * *